US007766707B2

(12) United States Patent
Vista, Jr. et al.

(10) Patent No.: US 7,766,707 B2
(45) Date of Patent: Aug. 3, 2010

(54) HYBRID ELECTRICAL PINS

(75) Inventors: Fidel P. Vista, Jr., Las Pinas (PH); Qing Wen Liu, Shen Zhen (CN)

(73) Assignee: Astec International Limited, Kwun Tong, Kowloon (HK)

( * ) Notice: Subject to any disclaimer, the term of this patent is extended or adjusted under 35 U.S.C. 154(b) by 188 days.

(21) Appl. No.: 11/900,886

(22) Filed: Sep. 13, 2007

(65) Prior Publication Data

US 2008/0174272 A1 Jul. 24, 2008

Related U.S. Application Data

(60) Provisional application No. 60/881,228, filed on Jan. 19, 2007.

(51) Int. Cl.
*H01R 9/24* (2006.01)

(52) U.S. Cl. ..... 439/891; 439/874; 439/879; 439/886; 439/166

(58) Field of Classification Search ..... 439/874, 439/879, 886, 891, 166
See application file for complete search history.

(56) References Cited

U.S. PATENT DOCUMENTS

| | | | | |
|---|---|---|---|---|
| 4,405,195 | A * | 9/1983 | Cherry et al. | 439/825 |
| 4,944,686 | A * | 7/1990 | Gertz | 439/175 |
| 5,984,696 | A * | 11/1999 | Lee | 439/79 |
| 6,004,172 | A * | 12/1999 | Kerek | 439/891 |
| 6,077,132 | A * | 6/2000 | Gligorijevic | 439/891 |
| 6,129,568 | A * | 10/2000 | Mercurio et al. | 439/166 |
| 7,057,111 | B2 | 6/2006 | Fung et al. | |
| 7,456,702 | B2 * | 11/2008 | Keefe et al. | 333/99 S |
| 2004/0009714 | A1 * | 1/2004 | Endo et al. | 439/856 |
| 2004/0192084 | A1 * | 9/2004 | Fronk | 439/75 |
| 2006/0025024 | A1 * | 2/2006 | Yamagami et al. | 439/886 |
| 2006/0205289 | A1 * | 9/2006 | Kumakura | 439/866 |

FOREIGN PATENT DOCUMENTS

| | | |
|---|---|---|
| EP | 0969561 | 1/2000 |
| GB | 2030378 | 4/1980 |
| GB | 2037495 | 7/1980 |
| GB | 2164507 | 3/1986 |
| GB | 2174255 | 10/1986 |
| JP | 11176509 | 7/1999 |

* cited by examiner

*Primary Examiner*—Tho D Ta
(74) *Attorney, Agent, or Firm*—Harness, Dickey & Pierce, P.L.C.

(57) ABSTRACT

In accordance with various embodiments of the present disclosure, a pin for an electrical connector is provided. The pin includes a head that is fixedly mated with a shaft to form the pin.

29 Claims, 7 Drawing Sheets

HYBRID ELECTRICAL PINS

CROSS-REFERENCE TO RELATED APPLICATIONS

This application claims priority to U.S. Provisional Application No. 60/881,228 filed on Jan. 19, 2007. The disclosure of the above application is incorporated herein by reference.

FIELD

The present teachings generally relate to electrically conductive pins utilized in various electrical connectors.

BACKGROUND

The statements in this section merely provide background information related to the present disclosure and may not constitute prior art.

Most electrical plug-in type connectors include one or more electrically conductive pins that extend from a connector/plug housing or base, and are adapted to be received by a mating device or connector that includes electrical receptors to thereby form an electrical connection. For example, mobile phone charger devices, audio equipment, video equipment, computer equipment, various control systems, and virtually all other electrical devices include various external and/or internal electrical connectors utilized to make electrical connections. Also, generally all electrical appliances and fixtures include plugs, i.e., a plug-in connector, used to connect the appliances and fixtures to a wall outlet/receptacle.

Typically, pins for such plug-in connectors and plugs are single piece pins. That is, the pins are constructed as a single, unitary, monolithic structure fabricated of single or homogenous non-ferrous metal, e.g., copper, brass, nickel or stainless steel, that are highly resistive to oxidization and corrosion. However, the cost of non-ferrous metals, particularly copper, is constantly rising in the world market, having a significant impact on the cost of producing such pins.

SUMMARY

In accordance with various embodiments of the present disclosure, a pin for an electrical connector is provided. The pin includes a head that is fixedly mated with a shaft to form the pin.

In accordance with various other embodiments of the present disclosure, an electrical connector is provided. The electrical connector includes at least one hybrid, two-part pin having a least a portion of a pin shaft enclosed within a connector housing. Each pin comprises a head that is fixedly mated with the shaft external to the connector housing.

In accordance with yet various other embodiments of the present disclosure, a method for fabricating a hybrid, two-part pin for an electrical connector is provided. The method comprises fixedly mating a pin shaft, having an electrically conductive metal core covered with a non-ferrous, electrically conductive plating, with a non-ferrous, electrically conductive pin head.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
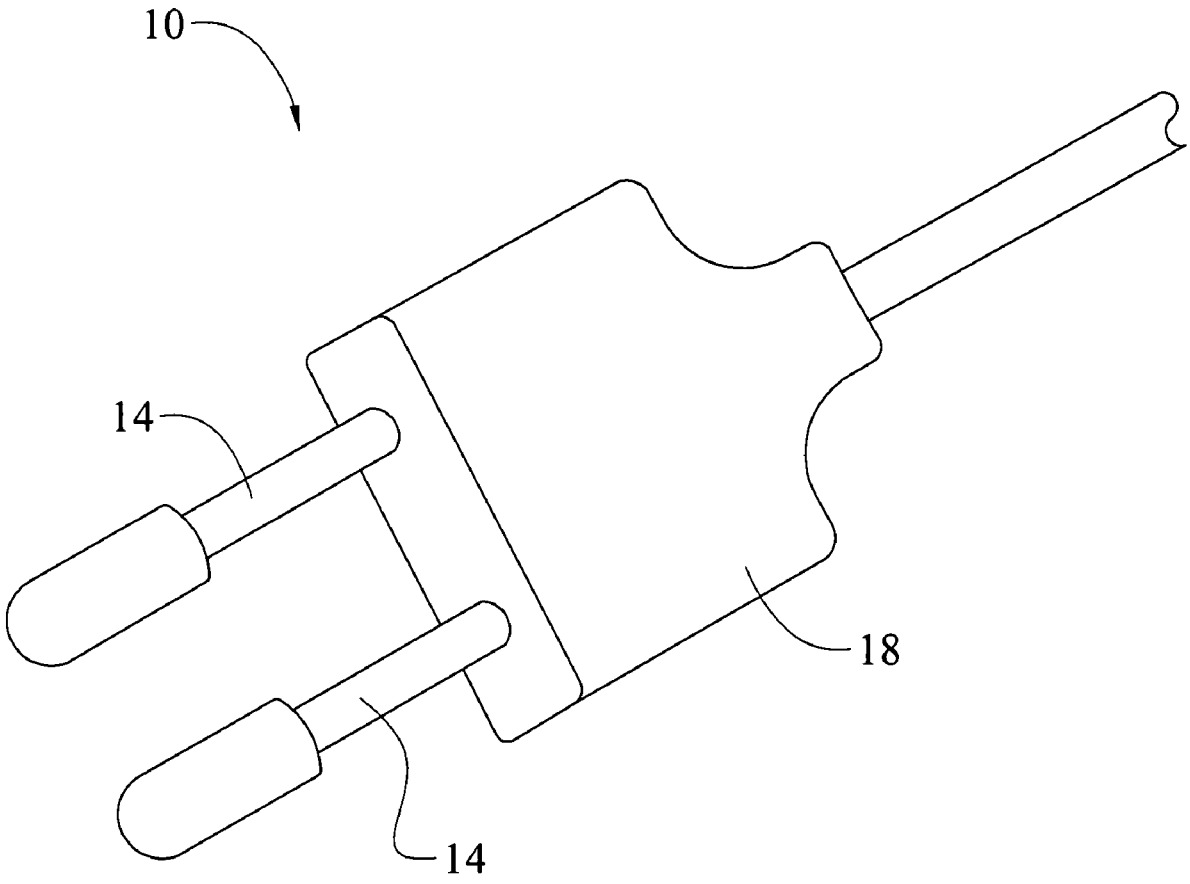
FIG. 1 is an isometric view of an exemplary plug-in connector including a plurality of hybrid, two-part electrically conductive pins, in accordance with various embodiments of the present disclosure.

The following description is merely exemplary in nature and is in no way intended to limit the present teachings, application, or uses. Throughout this specification, like reference numerals will be used to refer to like elements.

Referring to FIG. 1, a plug-in type electrical connector 10, e.g., a plug-in connector for a cellular phone charger device, is provided in accordance with various embodiments of the present disclosure. The electrical connector 10 includes one or more hybrid, two-part electrically conductive pins 14. The connector 10 generally includes a housing 18 that retains, houses, encloses and/or encapsulates a proximal end portion 20 (shown in FIG. 2) of each pin 14. It should be understood that although the connector 10 shown in FIG. 1 is described herein as a plug-in connector for a cellular phone charger device, FIG. 1 is merely an exemplary illustration and the scope of the present disclosure includes various other plug-in type electrical connectors. For example, the scope of the present disclosure includes such plug-in connectors as those utilized in mobile phone charger devices, computer equipment, various control systems, and virtually all other electrical devices that include various external and/or internal plug-in electrical connectors utilized to make electrical connections.

Also, the scope of the present disclosure includes plug-in connectors, i.e., plugs, that are utilized with generally all electrical appliances and fixtures for connecting the appliances and fixtures to a wall outlet/receptacle. Additionally, it should be understood that since hard wired communication connections are in fact electrical connections, the plug-in electrical connector 10 and pin(s) 14 described herein, are also applicable to electrical connections used for carrying electrical communications signals. For example, the connector 10 and pin(s) 14 can be employed in telephones, cellular phones, audio equipment, video equipment, etc.

Furthermore, although the exemplary connector 10 illustrated in FIG. 1 illustrates each hybrid, two-part pin 14 as being substantially the same, one or more of the pins 14 can have a different shape or profile. Further yet, although the exemplary connector 10 illustrated in FIG. 1 is shown to include a plurality of hybrid, two-part pins 14, the connector 10 can include one or more than one pin 14 and remain within the scope of the present disclosure. However, for clarity and simplicity, the description below will refer to a single pin 14.

Figure 2:
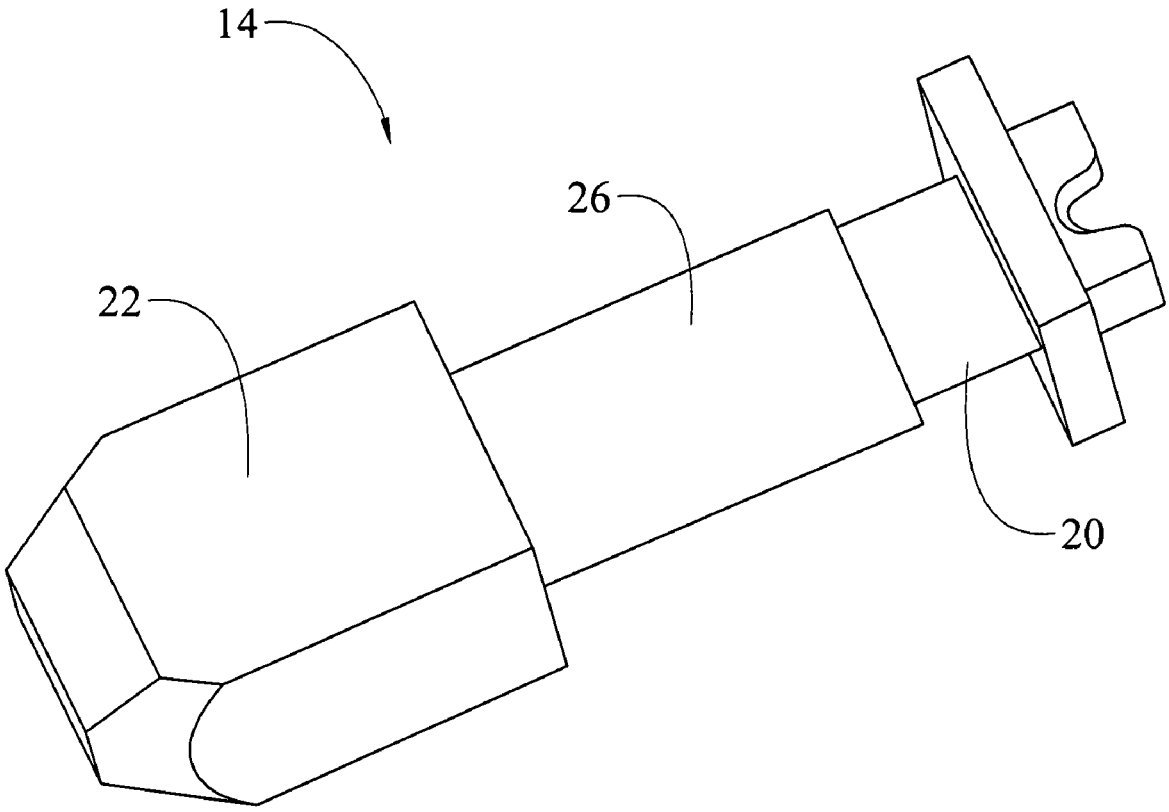
FIG. 2 is an isometric view of an exemplary hybrid, two-part electrically conductive pin of the type shown in FIG. 1, in accordance with various embodiments of the present disclosure.

Referring now to FIG. 2, each hybrid, two-part electrically conductive pin 14 includes a head 22 and a shaft 26. Specifically, the head 22 and shaft 26 are separate, independent components that are fixedly mated together to form the pin 14. Thus, the pin 14 is formed by fixedly mating two parts, i.e., the head 22 and the shaft 26, as opposed to being fabricated as a single, unitary, monolithic structure. The head 22 and shaft 26 can have any shape and dimensions suitable for the desired application and should not be interpreted as being limited to those illustrated throughout the various figures.

As described below, fabricating the pin 14 to have a two-part construction can provide significant material costs savings by appropriately selecting the materials used to fabricate the separate, independent head 22 and shaft 26.

In various embodiments, the head 22 can be fabricated, or manufactured, from a single electrically conductive metal or metal alloy. For example, the head 22 can be fabricated from a non-ferrous metal such as copper, nickel, brass, stainless steel, etc., that are highly resistive to oxidization and corrosion. Additionally, the shaft 26 can also be fabricated, or manufactured, from a single electrically conductive metal or metal alloy such as copper, nickel, brass, stainless steel, etc. The head 22 and shaft 26 can be fabricated from like metals or different metals that are physically compatible with each other.

For example, in accordance with various embodiments, the head 22 and shaft 26 are fabricated from different metals. Thus, through appropriate metal selection, fabricating the head 22 and shaft 26 of different metals can significantly reduce material costs. For example, the head 22 can be fabricated from a first metal and the shaft 26 can be fabricated from a less expensive second metal, or vise-versa, thereby reducing the material costs from those incurred when fabricating the head 22 and shaft 26 of like materials.

Figure 3:
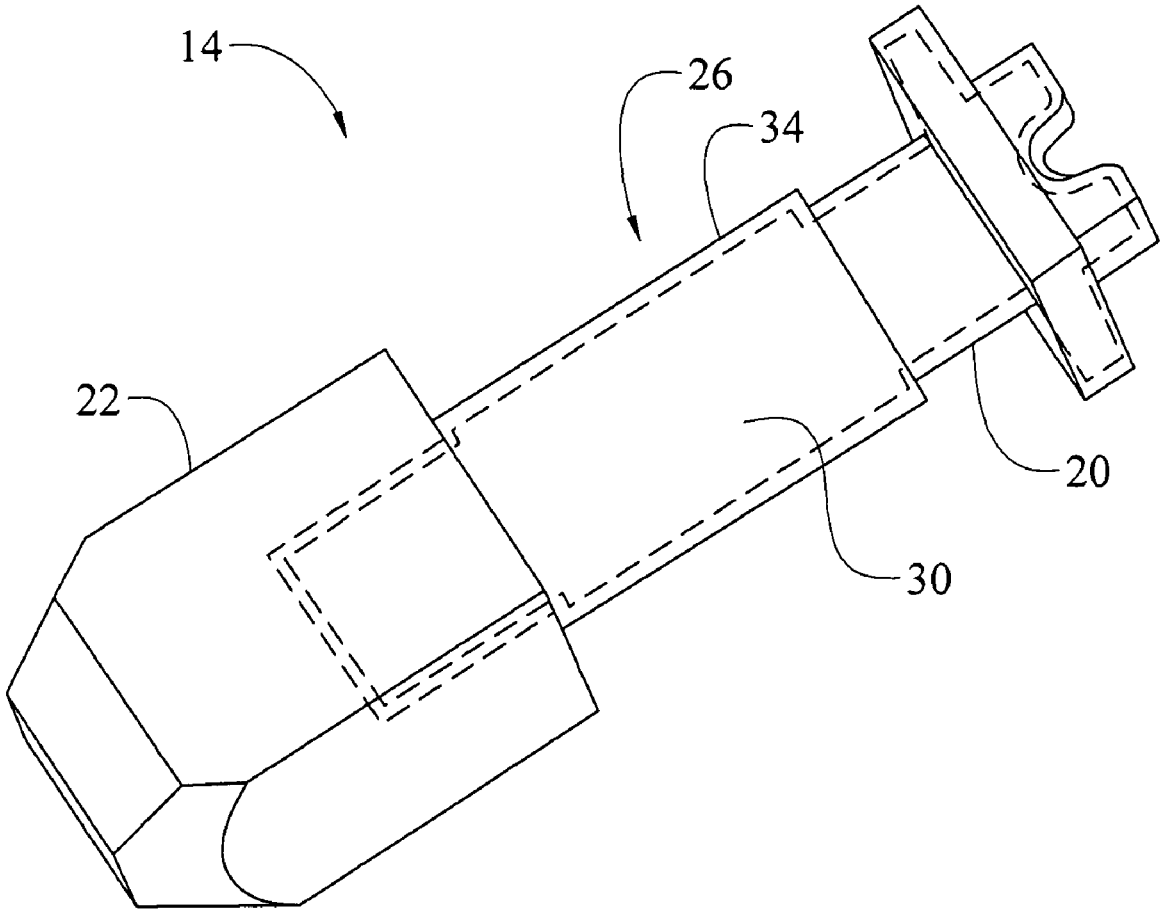
FIG. 3 is an isometric view of an exemplary hybrid, two-part electrically conductive pin of the type shown in FIG. 1 having a shaft comprised of an electrically conductive core covered with an electrically conductive plating, in accordance with various embodiments of the present disclosure.

Referring to FIG. 3, in various embodiments, the shaft 26 can include a core 30 fabricated of a first electrically conductive material, e.g., a metal or metal alloy, that is covered with a plating 34 fabricated of a second electrically conductive material, e.g., metal or metal alloy. For example, in various implementations, the shaft core 30 can be fabricated of a ferrous material and the shaft plating 34 can be fabricated of a non-ferrous material. Generally, ferrous materials are less expensive than non-ferrous materials. However, ferrous materials are prone to oxidize and/or corrode, while non-ferrous materials are generally highly resistive to oxidation and corrosion. Thus, by fabricating the plating 34 from a substantially non-oxidizing, non-corrosive non-ferrous material and the core 30 from a less expensive ferrous material, significant material costs can be achieved to fabricate the pin shaft 26 that is substantially non-oxidizing and non-corrosive.

Any ferrous material, such as carbon steel, can be employed to fabricate the ferrous shaft core 30 and any electrically conductive non-ferrous material, such as nickel, can be employed to fabricate the non-ferrous shaft plating 34. Alternatively, the shaft core 30 and the shaft plating 34 can be fabricated of two different ferrous materials, or of two different non-ferrous materials.

Figure 4:
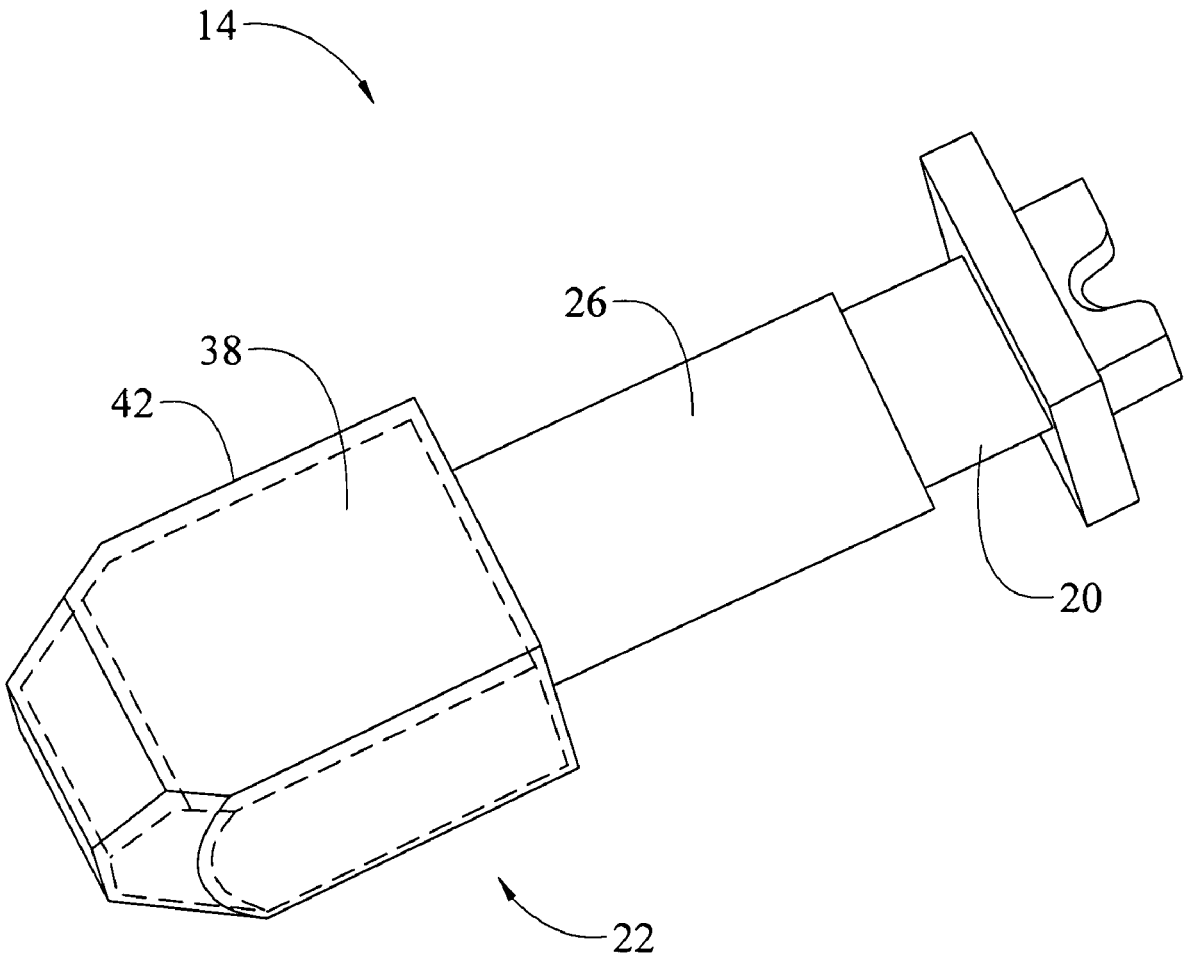
FIG. 4 is an isometric view of an exemplary hybrid, two-part electrically conductive pin of the type shown in FIG. 1 having a head comprised of an electrically conductive core covered with an electrically conductive plating, in accordance with various embodiments of the present disclosure.

Referring to FIG. 4, in various embodiments, the head 22 includes a core 38 fabricated of a first electrically conductive material, e.g., a metal or metal alloy, that is covered with a plating 42 fabricated of a second electrically conductive material, e.g., metal or metal alloy. For example, in various implementations, the head core 38 can be fabricated of a ferrous material and the head plating 42 can be fabricated of a non-ferrous material. As described above, ferrous materials are prone to oxidize or corrode, while non-ferrous materials are generally highly resistive to oxidation and corrosion. Thus, by fabricating the head plating 42 from a substantially non-oxidizing, non-corrosive non-ferrous material and the head core 38 from a less expensive ferrous material, significant material costs can be achieved to fabricate the pin head 22 that is substantially non-oxidizing and non-corrosive.

Any ferrous material, such as carbon steel, can be employed to fabricate the ferrous head core 38 and any electrically conductive non-ferrous material, such as nickel, brass or copper, can be employed to fabricate the non-ferrous head plating 42. Alternatively, the head core 38 and the head plating 42 can be fabricated of two different ferrous materials, or of two different non-ferrous materials.

Referring now to FIGS. 3 and 4, in various embodiments, the shaft 26 and the head 22 can each comprise a core 30 and 38, and a plating 34 and 42, in accordance with the description above.

Figure 5:
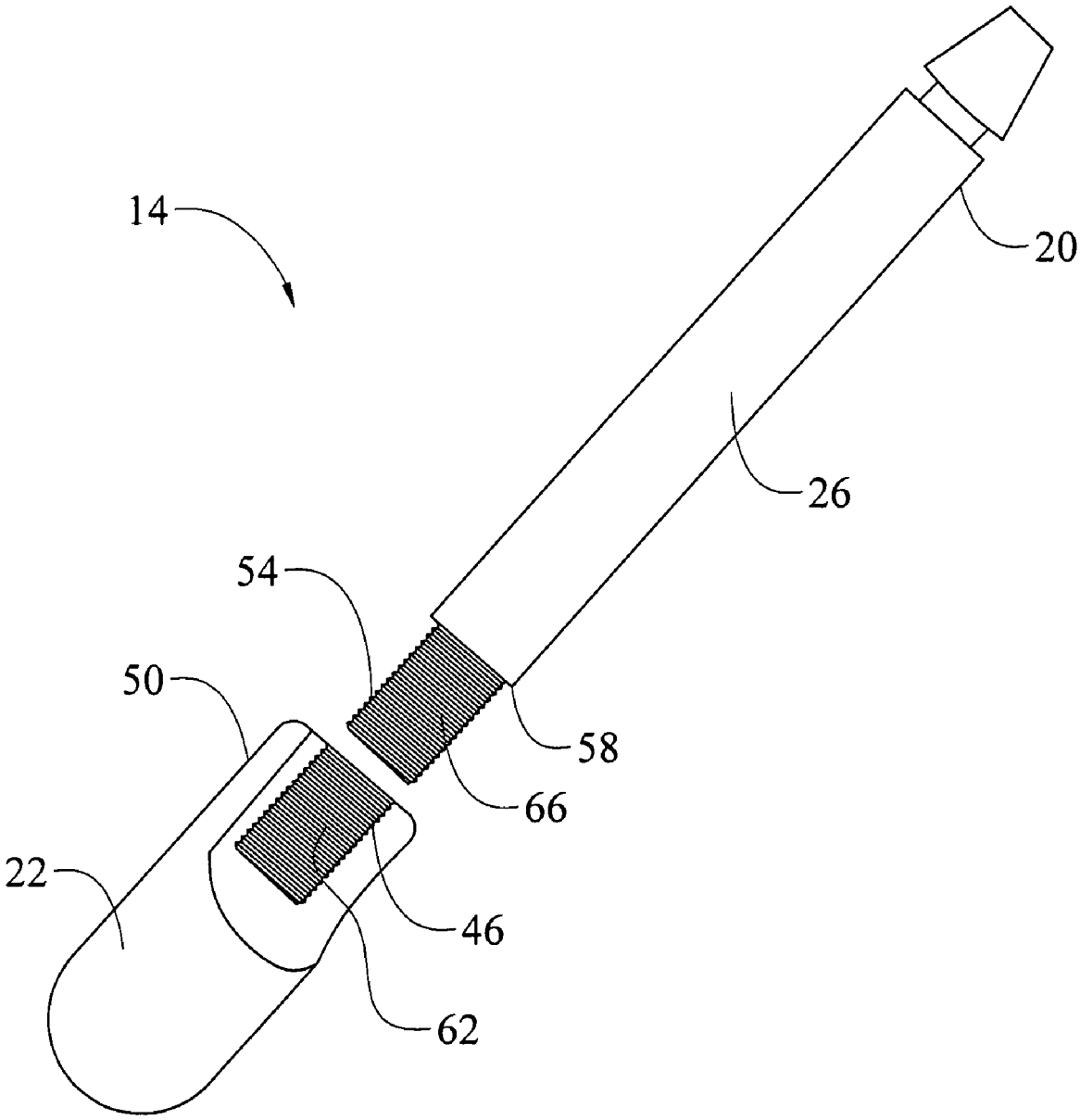
FIG. 5 is an isometric exploded view illustrating a means for substantially permanently affixing the pin head with the pin shaft to form the hybrid, two-part electrically conductive pin shown in FIG. 1, in accordance with various embodiments of the present disclosure.
Figure 6:
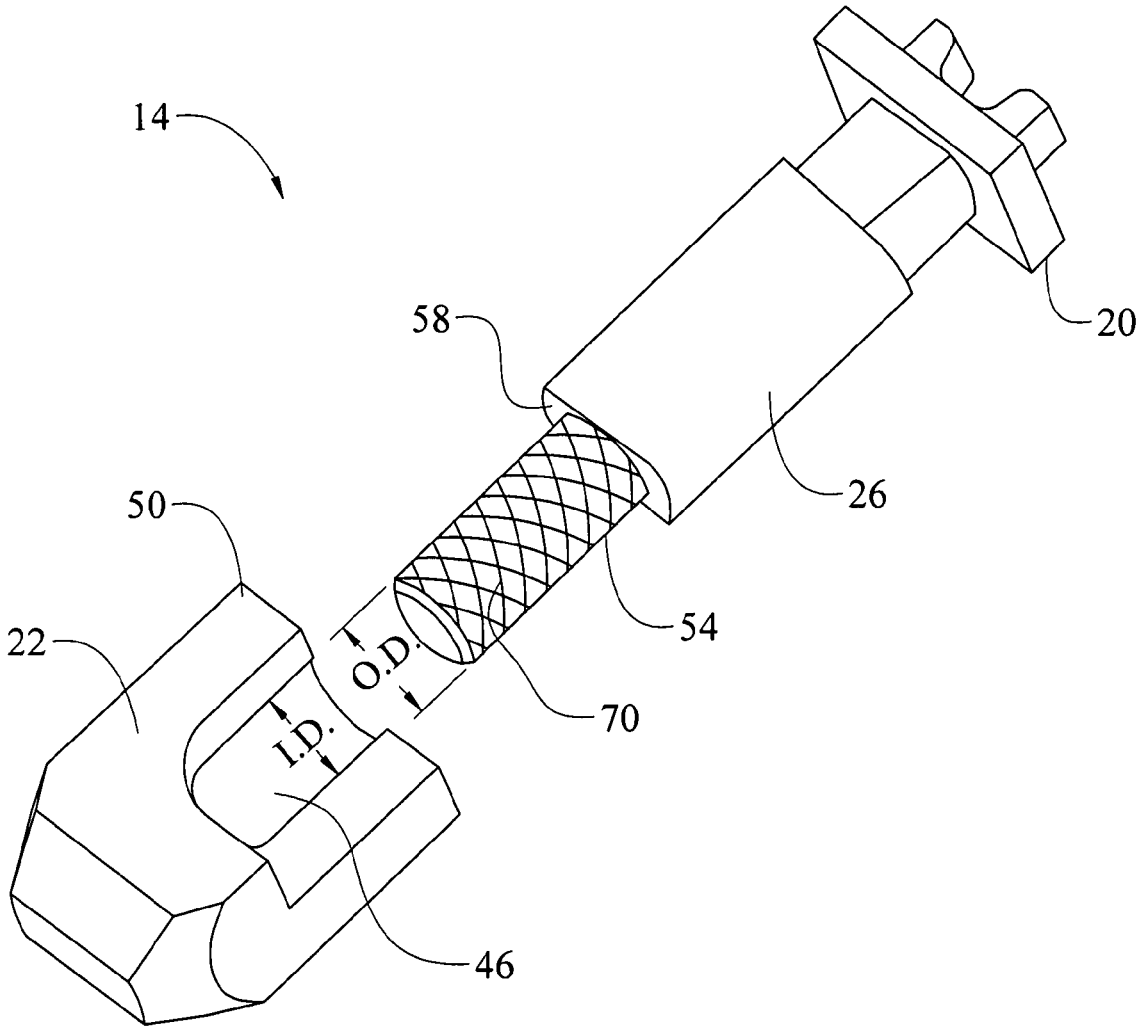
FIG. 6 is an isometric exploded view illustrating a means for substantially permanently affixing a pin head with a pin shaft to form a hybrid, two-part electrically conductive pin of the type shown in FIG. 1, in accordance with various other embodiments of the present disclosure.
Figure 7:
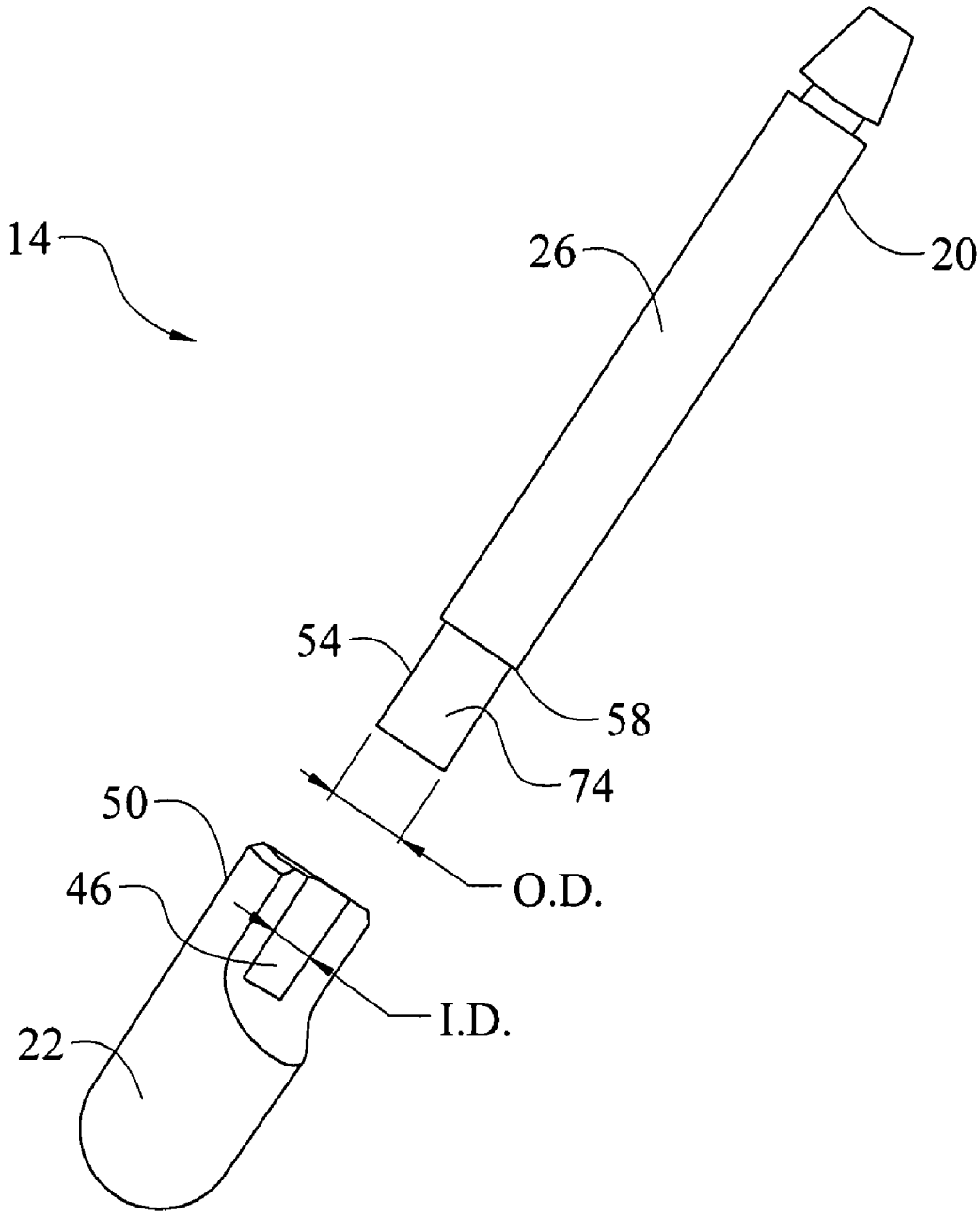
FIG. 7 is an isometric exploded view illustrating a means for substantially permanently affixing the pin head with the pin shaft to form the hybrid, two-part electrically conductive pin shown in FIG. 1, in accordance with yet other various embodiments of the present disclosure.

Referring now to FIGS. 5, 6 and 7, as described above, the shaft 26 is fixedly mated with the head 22 to form the hybrid, two-part pin 14. That is, the shaft 26 and head 22 are fitted together and then substantially permanently affixed or joined with each other. The shaft 26 and head 22 can be fixedly mated in any suitable manner that will substantially permanently join the shaft 26 and head 22 to form the pin 14.

For example, referring to FIGS. 5, 6 and 7, in various embodiments, the head 22 can include a bore 46 that extends into a tail portion 50 of the head 22. Additionally, the shaft 26 can include a neck portion 54 at a distal end portion 58 of the shaft 26 that can be fixedly mated or secured within the bore 46 to form the pin 14. The neck portion 54 can be fixedly mated within the bore 46 using any means or method suitable for substantially permanently securing the head 22 with the shaft 26.

For example, referring to FIG. 5, in various embodiments, the head bore 46 can include internal threads 62 and the shaft neck portion 54 can include external threads 66. To form the pin 14, the bore internal threads 62 and the neck portion external threads 66 are fixedly engaged, i.e., threaded together, to substantially secure the head 22 with the shaft 26. Additionally, in various implementations, once the threads 62 and 66 are fixedly engaged, the neck portion 54 can be ultrasonically welded within the bore 46 to substantially permanently secure the head 22 with the shaft 26.

Referring now to FIG. 6, in various embodiments, the shaft neck portion 54 can include a plurality of external knurls 70. Additionally, an inside diameter ID of the head bore 46 can be sized to be slightly less than an outside diameter OD of the shaft neck portion 54. Thus, to form the pin 14, the neck portion 54 is force fitted within the bore 46 such that the knurls 70 fixedly engage the bore 46 with the neck portion 54 to substantially permanently secure the head 22 with the shaft 26. Additionally, in various implementations, once the neck portion 54 is force fitted within the bore 46 the neck portion 54 can be ultrasonically welded within the bore 46.

Referring now to FIG. 7, in various embodiments, the shaft neck portion 54 can include a substantially smooth outer surface 74. Additionally, the bore inside diameter ID can be sized to be substantially equal to the outside diameter OD of the shaft neck portion 54. To form the pin 14, the neck portion 54 is fitted and ultrasonically welded within the bore 46.

Therefore, in accordance with the description above, the hybrid, two-part pin 14 includes two separate, independent components, i.e., the head 22 and the shaft 26, that are fixedly mated together to form the pin 14. Additionally, the shaft 26 and/or the head 22 can each be fabricated or constructed to have a core 30 and/or 38 that is covered by a plating 34 and/or 42. Fabricating the pin having a two-part construction, i.e., the head 22 and the shaft 26, and having a hybrid composition, i.e., core and plating, of the head 22 and/or shaft 26, can significantly reduce the material costs of fabricating pin 14.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. An electrically conductive pin for an electrical connector comprising an electrically conductive head and an electrically conductive shaft fabricated independently of each other and permanently mated together to form the pin with the head electrically connected to the shaft, the head including a first material, the shaft including a second material different than the first material, the first and second materials being rigid metals such that when the electrically conductive pin is inserted into a pin receptor, the head and shaft are not substantially deformed.

2. The pin of claim 1, wherein the shaft comprises an electrically conductive core and an electrically conductive plating covering the core.

3. The pin of claim 2, wherein the shaft core is fabricated of a ferrous material and the shaft plating is fabricated of a non-ferrous material.

4. The pin of claim 3, wherein the ferrous shaft core is fabricated of carbon steel.

5. The pin of claim 3, wherein the shaft non-ferrous plating is fabricated of nickel.

6. The pin of claim 1, wherein the head is fabricated of a single electrically conductive material selected from the group consisting of brass, nickel, copper and stainless steel.

7. The pin of claim 1, wherein the head comprises an electrically conductive core and an electrically conductive plating covering the core.

8. The pin of claim 7, wherein the head core is fabricated of a ferrous material and the head plating is fabricated of a non-ferrous material.

9. The pin of claim 8, wherein the ferrous head core is fabricated of carbon steel.

10. The pin of claim 8, wherein the non-ferrous head plating is fabricated of one of nickel and brass.

11. The pin of claim 1, wherein the head comprises a bore and the shaft comprises a neck portion that is permanently mated within the bore.

12. The pin of claim 11, wherein the neck portion comprises a knurled outer surface force fitted within the bore.

13. The pin of claim 11, wherein the neck portion is ultrasonically welded within the bore.

14. The pin of claim 11, wherein the neck portion is soldered within the bore.

15. The pin of claim 11, wherein the head bore comprises internal threads and the shaft neck portion comprises external threads fixedly engaged with bore internal threads.

16. The pin of claim 1, wherein the shaft is fabricated of a single electrically conductive material.

17. The pin of claim 16, wherein the shaft is fabricated from one of, copper, brass, nickel or stainless steel.

18. An electrical connector comprising at least one metal hybrid, two-part pin, each pin comprising an electrically conductive head adapted to electrically connect with a pin receptor of an electrical device, and an electrically conductive shaft fabricated independently from the head and permanently secured with the head, the head and the shaft structured such that when the two-part pin is inserted into the pin receptor, the head and shaft are not substantially deformed.

19. The connector of claim 18, wherein the shaft comprises an electrically conductive, ferrous core and a non-ferrous, electrically conductive plating covering the core.

20. The connector of claim 19, wherein the ferrous shaft core is fabricated of carbon steel and the shaft non-ferrous plating is fabricated of nickel.

21. The connector of claim 18, wherein the head comprises an electrically conductive, non-ferrous material and the shaft comprises an electrically conductive ferrous material.

22. The connector of claim 21, wherein the ferrous material is fabricated of carbon steel and the non-ferrous material is fabricated of one of nickel and brass.

23. The connector of claim 18, wherein the head comprises a bore and the shaft comprises a shaft neck portion having a knurled outer surface and the neck portion is force fitted within the bore.

24. The connector of claim 18, wherein the head comprises a bore and the shaft comprises a neck portion that is ultrasonically welded within the bore.

25. The connector of claim 18, wherein the head comprises a bore and the shaft comprises a neck portion that is soldered within the bore.

26. The connector of claim 18, wherein the head comprises a bore having internal threads and the shaft comprises a neck portion having external threads fixedly engaged with bore internal threads.

27. A cellular phone charging device comprising an electrical connector including at least one metal hybrid, two-part pin, each pin comprising a head and a shaft fabricated independently from each other and permanently secured together to form the at least one pin, the shaft including an electrically conductive ferrous material, the head including an electrically conductive non-ferrous material, the ferrous material and the non-ferrous material being rigid materials such that when the two-part pin is inserted into a pin receptor, the head and shaft are not substantially deformed.

28. The device of claim 27, wherein the shaft comprises an electrically conductive ferrous core and a non-ferrous, electrically conductive plating covering the core.

29. The device of claim 27, wherein the pin comprises one of:

the head including a bore and the shaft including a neck portion having a knurled outer surface and the neck portion is force fitted within the bore;

the head including a bore and the shaft including a neck portion ultrasonically welded within the bore;

the head including a bore and the shaft including a neck portion soldered within the bore; and the head including a bore having internal threads and the shaft including a neck portion having external threads fixedly engaged with bore internal threads.

* * * * *